United States Patent [19]

Tilson et al.

[11] Patent Number: 4,592,213

[45] **Date of Patent: * Jun. 3, 1986**

[54] PNEUMATIC FIBER RECOVERY AND REDISTRIBUTION SYSTEM FOR SLIVER HIGH PILE FABRIC KNITTING MACHINES

[75] Inventors: Alan L. Tilson; Earl R. Quay, both of Orangeburg; John C. Knight, North, all of S.C.

[73] Assignee: Mayer, Wildman Industries, Inc., Orangeburg, S.C.

[ * ] Notice: The portion of the term of this patent subsequent to Aug. 6, 2002 has been disclaimed.

[21] Appl. No.: 761,565

[22] Filed: Aug. 1, 1985

Related U.S. Application Data

[63] Continuation-in-part of Ser. No. 647,632, Sep. 5, 1984, Pat. No. 4,532,780, which is a continuation-in-part of Ser. No. 539,801, Oct. 7, 1983, abandoned.

[51] Int. Cl.[4] ..... D04B 9/14; D01G 15/40

[52] U.S. Cl. ..... 66/9 B; 19/105; 19/107; 19/109

[58] Field of Search ..... 66/9 B; 19/97, 105, 19/106 R, 107, 109, 112

[56] References Cited

U.S. PATENT DOCUMENTS

| | | | |
|---|---|---|---|
| 2,823,423 | 2/1958 | Suzuki | 19/109 |
| 3,728,872 | 4/1973 | Thore | 19/107 X |
| 4,458,506 | 7/1984 | Artzt et al. | 66/9 B |

*Primary Examiner*—Louis K. Rimrodt
*Attorney, Agent, or Firm*—Robert B. Frailey

[57] ABSTRACT

Apparatus for removing excess fibers from the doffer of a sliver high pile fabric knitting machine and returning the fibers to the main cylinder for refeeding to the doffer. During the return of the fibers to the main cylinder, they are combed and aligned into a thin uniform film of parallel fibers for uniform redistribution on the main cylinder and uniform mixture with fresh, incoming fibers fed to the main cylinder by the sliver feed elements. The invention includes pneumatic suction for drawing fibers from the doffer into a substantially closed suction chamber, a flat perforated filter sheet fixed within the chamber to separate the fibers from the air currents in the chamber and a rubber covered sealing roll permitting the fibers to be discharged from the chamber to the ambient atmosphere without impairing the integrity of the vacuum in the chamber. Fiber feeding elements composed of a rotatable wire-covered fiber transfer roller and a rotatable wire-covered fiber return feed roller return the recovered fibers to the main cylinder.

8 Claims, 2 Drawing Figures

PNEUMATIC FIBER RECOVERY AND REDISTRIBUTION SYSTEM FOR SLIVER HIGH PILE FABRIC KNITTING MACHINES

RELATED APPLICATION

This application is a continuation-in-part of our pending patent application Ser. No. 647,632, filed Sept. 5, 1984 and entitled "Pneumatic Fiber Recovery and Redistribution System for Sliver High Pile Fabric Knitting Machines", now U.S. Pat. No. 4,532,780 granted Aug. 6, 1985 said application being, in turn, a continuation-in-part of our abandoned patent application Ser. No. 539,801, filed Oct. 7, 1983 and entitled "Pneumatic Fiber Recovery and Redistribution System for Sliver High Pile Fabric Knitting Machines".

The present invention concerns the knitting of sliver high pile fabrics on circular knitting machines, and constitutes an improvement of the invention which is the subject of patent application Ser. No. 647,632 aforesaid, filed Sept. 5, 1984. The disclosure of said patent application is incorporated herein by reference.

The primary object of this invention is to provide new and improved apparatus and method for removing excess fibers from the doffer of a sliver high pile fabric knitting machine and returning the fibers to, and uniformly redistributing them on, the main cylinder for refeeding to the doffer, thereby eliminating non-uniformity of pile density in the knitted fabric.

A further object of the invention is to recover excess fibers from the doffer for return to the main cylinder and, in the course of returning the fibers, combing and aligning them into a uniform layer of parallel fibers for uniform redistribution on the main cylinder.

A further object is to uniformly redistribute the fibers recovered from the doffer so that they are uniformly mixed with fresh, incoming fibers being fed to the main cylinder by the sliver feeding elements.

A further object is to provide, for a fiber transfer and feeding unit for a sliver high pile fabric knitting machine, a novel fiber recovery system for removing excess fibers from the doffer, pneumatically sucking them into and collecting them internally of a suction chamber, then discharging the collected fibers from the chamber while maintaining the integrity of the vacuum therein, forming the discharged fibers into a uniform layer of fibers for uniform redistribution on the main cylinder and aligning the fibers while delivering them to the main cylinder for refeeding to the doffer.

A further object is to provide novel apparatus for carrying out the foregoing fiber recovery and redistribution system which includes a suction chamber in which the recovered fibers are collected pneumatically and from which they are discharged into the ambient atmosphere for reception by fiber feeding elements for returning the recovered fibers back to the main cylinder for refeeding to the doffer, the apparatus including a perforated filter for separating the fibers from the air in the chamber, a rubber sealing roller for maintaining the integrity of the vacuum during discharge of the fibers from the chamber and fiber feeding elements comprising intermeshing, rotatable, wire-covered fiber transfer and return feed rolls for advancing the recovered fibers, and for combing and aligning them into a uniform layer of parallel fibers while returning them to the main cylinder, whereby the recovered fibers are uniformly distributed on the main cylinder and uniformly mixed with the fresh incoming fibers disposed thereon.

The novel pneumatic fiber recovery and redistribution system of the invention not only provides for the continuous return of excess fibers from the doffer to the main cylinder, for refeeding to the doffer with fresh fibers, but it also reworks the recovered fibers, as they are returned to the main cylinder, by combing and aligning them into a layer of parallel fibers of uniform density for redistribution on the main cylinder. The recovered fibers not only are blended uniformly with the new fibers on the main cylinder, but the problem of non-uniformity of pile density in knitted high pile fabrics, which long has plagued the industry, finally is solved by this invention.

Other objects and advantages of this invention will be readily apparent from the accompanying detailed description of the preferred embodiment thereof, which is illustrated in the views of the accompanying drawing.

DESCRIPTION OF THE INVENTION

Figure 1:
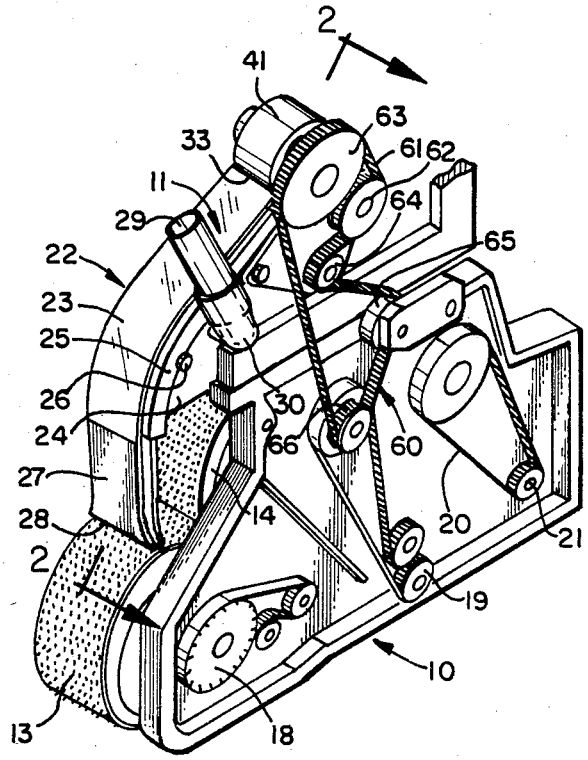
FIG. 1 is a fragmentary view in perspective of a carding head for a sliver high pile fabric knitting machine incorporating the improved fiber recovery and redistribution system of this invention.

The herein described invention constitutes an improvement of the invention which is the subject of patent application Ser. No. 647,632 aforesaid, filed Sept. 5, 1984. The whole of the disclosure of that patent application is incorporated herein by reference, and constitutes part of this specification.

Referring to the drawing, there is illustrated a fiber transfer and feeding unit 10, often referred to as a "carding head", for processing sliver fibers and transferring and feeding them to the needles of a sliver high pile fabric knitting machine (not shown). The fiber feeding unit 10 is provided with the novel pneumatic fiber recovery and redistribution device of this invention, generally indicated by the reference numeral 11.

The fiber transfer and feeding unit 10 includes a rotatable wire-covered doffer 13 for feeding fibers to the knitting machine needles (not shown), a rotatable wire-covered main cylinder 14 and at least one pair of mating sliver feed rolls (not shown) for feeding a sliver to the main cylinder 14 in the usual manner.

The doffer 13, main cylinder 14 and sliver feed rolls are driven, respectively, by conventional pulley systems 18, 19 and 20. The pulley drive systems 18 and 19 for the doffer 13 and main cylinder 14 are driven from the ring gear of a knitting machine by a conventional gear drive system (not shown). The pulley drive system 20 for driving the feed rolls is connected to a drive shaft 21 which, in turn, may be connected to a stepping motor (not shown). Alternatively, the sliver feed roll shaft 21 may be driven by the ring gear of the knitting machine through conventional gearing (not shown).

The pneumatic fiber recovery and redistribution device 11 includes a hollow, elongated suction chamber 22 of generally rectangular cross section. The suction chamber 22 is of approximately the same width as the doffer 13, and its hollow interior is of relatively narrow depth throughout its length. The lower or depending portion of the suction chamber 22 is constituted by a four sided tapering nozzle 27 which terminates in a narrow, transversely extending suction mouth 28 located proximate the wire-covered periphery of the doffer 13. Preferably, mouth 28 is of the same width as the interior of the suction chamber 22, and hence is of approximately the same width as the doffer 13. Although the hollow interior of the nozzle 27 also is of generally rectangular cross section, its depth gradually narrows in the direction of its elongated mouth 28. Nozzle 27 preferably is made entirely of heat-treated steel.

The hollow suction chamber 22 also includes a continuous outer cover 23 of inverted U-shaped configuration, which provides the transverse front wall and the spaced side walls of the upper portion of that chamber. The lower portion of the U-shaped suction chamber cover 23 is of curved configuration whereas its upper portion is of relatively straight or rectangular configuration. Preferably, suction chamber cover 23 is made of an integral transparent plastic material.

The inverted U-shaped suction chamber cover 23 is affixed to the upper portion of a hollow body member 24 by a pair of transversely spaced, flat, elongated and partially curved clamps 25. The upper transverse surface of body 24 and the transverse front wall of the suction chamber cover 23 preferably are complemental in configuration, and are spaced apart uniformly to provide the hollow interior of the upper portion of the suction chamber 22.

Preferably, both the body member 24 and the narrow, axially spaced clamps 25 are formed of hardened steel. A plurality of threaded bolts 26 pass through apertures in the clamps 25 and engage threadingly within taped holes formed in the body 24, whereby the clamps 25 securely affix the plastic suction chamber cover 23 to the top of the metallic body member 24.

The upper end of the nozzle 27 is affixed to the lower front portion of the body 24 by any conventional means, such as by welding. The lower end of the chamber cover 23 is affixed to the upper end of the nozzle 27 by a force fit, or by an adhesive, such as an epoxy adhesive, or by mechanical means, such as clamps or bolts. Thus, nozzle 27, outer chamber cover 23 and body member 24 constitute a rigid, unitary structure which provides the hollow suction chamber 22 of the pneumatic device 11.

The body 24 is provided with a hollow interior 32 which is covered by an upper transverse plate or wall 36. The hollow interior 32 of body 24 communicates with the hollow interior of the suction chamber 22 through a flat perforated filter area 35 formed in the upper portion of the wall 36. The area 35 may constitute an integral part of plate 36, or it may be a separate perforated sheet of thin metal or plastic. In either event, wall 36 and filter 35 are affixed by any suitable means to the upper portion of body 24 intermediate its hollow interior 32 and that of the suction chamber 22. The perforated filter 35 separates the fibers F from the air currents which suck fibers on the doffer 13 into the suction chamber 22.

The hollow interior 32 of the body 24 is connected to a suction manifold (not shown) by a hollow conduit 29. The conduit 29 connects to a suitable hollow fitting 30 affixed to one side wall of the body 24. The hollow of fitting 30, in turn, communicates with the interior 32 of the body 24 via an aperture 31 formed in the side wall of the body. The suction manifold aforesaid (not shown) is suitably connected to any conventional vacuum source, such as a blower (also not shown). In operation, atmospheric air is sucked into the chamber 22 via the elongated suction mouth 28 located proximate the doffer 13. The air flows from chamber 22 via the perforated filter 35 into hollow 32 and discharges from the hollow 32 via aperture 31, fitting 30 and conduit 29 to the suction manifold. As a result, excessive fibers F on the wires of the doffer 13 are drawn through suction mouth 28 into the chamber 22 for refeeding to the main cylinder 14.

The upper end of the vacuum chamber 22 terminates in a narrow, elongated fiber discharge aperture 33 through which fibers F sucked from the doffer 13 are discharged to the ambient atmosphere. Rotatably mounted adjacent the fiber discharge aperture 33 is a rubber-covered, smooth peripheried sealing roller 41. The rotatable sealing roller 41 extends across the full width of the fiber discharge opening 33, and is operative to substantially close the suction chamber 22 at that location.

Body member 24 is provided on its upper surface with a transversely extending, concave area 34 which is complemental in configuration to, and closely spaced to, the periphery of the sealing roller 41. The upper end of the suction chamber cover 23 also is configured to complement the periphery of the sealing roller 41, and also is disposed closely adjacent thereto. The near contiguousness of the periphery of the sealing roller 41 with the upper end of the chamber cover 23 and with the transversely extending concave surface 34 of body 24 provides an air restricted fiber passage at the location 33 where the fibers F are discharged from the suction chamber 22, and functions to maintain the integrity of the vacuum in that chamber.

Mounted rotatably adjacent to, and below, the sealing roller 41 is a wire-covered fiber transfer roller 38. The wire periphery of the fiber transfer roller 38 is disposed in close proximity to a complementally shaped, transversely extending, concave surface 39 formed in the outer rear wall of body member 24.

Rotatably mounted intermediate the fiber transfer roller 38 and the main cylinder 14, and meshing with both of those rotatable elements, is the wire-covered fiber return feed roll 54. Disposed rearwardly of the return feed roll 54 is an elongated apron 46 provided with a concave, transversely extending, front surface 52. The concave surface 52 is complemental in configuration to, and is disposed in close proximity to, the wire periphery of the fiber return feed roll 54.

Sealing roller 41, fiber transfer roller 38, fiber return feed roller 54 and apron 46 are all of approximately the same length, and all are of a length approximating the width of the main cylinder 14.

The pulley drive system 60 for the rotatable components 38, 41 and 54 of the pneumatic fiber recovery device 11 comprises a double sided toothed belt 61, toothed pulley 62 affixed to fiber transfer roller 38, toothed pulley 63 affixed to sealing roller 41, toothed pulley 64 affixed to fiber return feed roller 54 and toothed idler pulley 65. The drive system 60 is connected drivingly to the pulley drive system 19 for the main cylinder 14 by means of a reduced toothed pulley 66.

Figure 2:
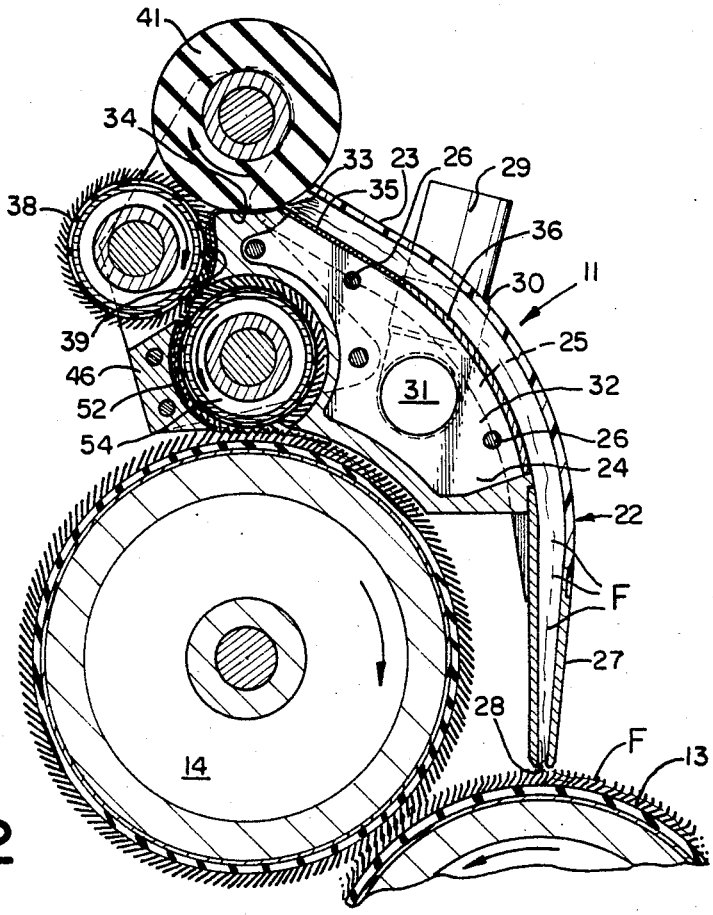
FIG. 2 is an enlarged fragmentary view in section of the carding head looking in the direction of the angled arrows 2—2 of FIG. 1.

The fiber return area for uniformizing the recovered fibers F and returning them to the main cylinder 14 is located in the ambient atmosphere and is defined by the rubber-covered sealing roller 41, concave surface 34, wire-covered fiber transfer roller 38, concave surface 39, wire-covered fiber return feed roller 54 and concave apron surface 52. When the suction device 11 is operative, and air is sucked into the chamber 22 via the elongated suction mouth 28, the excess fibers F on the doffer 13 are entrained with the moving air and drawn into the chamber, as illustrated in FIG. 2.

To ensure that the incoming fibers F are handled as gently and as consistently as possible, the intermediate portion of the suction chamber 22 is formed with a smooth, large radius, curved configuration, while the upper portion of the chamber, leading to the fiber discharge opening 33, is rectilinear. The intertia of the fibers F carries them over the stationary perforated area or filter 35 to the sealing roller 41 adjacent opening 33, for discharge to the ambient atmosphere. Sealing roller 41 meters the fibers out of the suction chamber 22 to the fiber transfer roller 38. The deflectability of the rubber periphery of the sealing roller 41 provides clearance for the fibers F discharging from the chamber 22 through the opening 33.

The fiber transfer roller 38 accepts the fibers from the sealing roller 41 and transfers them to the fiber return feed roller 54. As the fibers are transferred from the sealing roller 41 to the return feed roller 54 they are combed, by the wires of rollers 38 and 54, into a thin, uniform sheet or film of parallel fibers.

The fiber return feed roller 54 transfers the sheet of fibers from transfer roller 38 to the main cylinder 14. As it does so, the sheet or film of fibers is further thinned and uniformized by the combing action of the wire peripheries of the roller 54 and main cylinder 14. As a result of this improved fiber return process, a highly consistent and uniform fiber return flow is produced, resulting in highly improved quality in the pile density of the sliver knit fabric produced by the knitting machine (not shown).

The transverse concave surfaces 34, 39 and 52 adjacent each of the three fiber redistribution rollers 41, 38 and 54, respectively, function as control surfaces and aid in providing consistent and uniform fiber flow to the main cylinder 14. Preferably, very slight or minimum working clearances are maintained between the control surfaces 34, 39 and 52 and the peripheries of their respective rollers 41, 38 and 54, preferably within the range of 0.1 mm to 1.0 mm.

In line with usual practice, the surface speed of each of the succeeding rollers 41, 38, 54 and 14 is higher than that of its immediately preceding roller, to provide selected fiber draw ratios which, as is well known in the art, contributes significantly to the combing of the fibers F into a thin uniform film of parallel fibers during their transfer from the suction chamber 22 to the main cylinder 14. Thus, the fibers are uniformly returned to and redistributed on the main cylinder 14 and are uniformly mixed with the fresh incoming fibers fed thereto by the usual sliver feed roll (not shown).

Although a preferred embodiment of the improvement to this invention has been shown and described herein for the purpose of illustration, it is to be understood that various changes, modifications and alterations may be made thereto without departing from the spirit and utility of the invention, or from the scope thereof as set forth in the claims.

We claim:

1. A pneumatic fiber recovery and redistribution device for sliver high pile fabric knitting machines for returning fibers from the doffer to the main cylinder of a fiber transfer and feeding unit, said device having a suction chamber into which fibers are sucked from the doffer, fiber discharge means for discharging the fibers from the suction chamber and fiber return means disposed externally of the suction chamber for delivering discharged fibers to the main cylinder, said fiber return means being characterized by (a) a sealing roller disposed adjacent the fiber discharge means of the suction chamber, (b) a fiber return feed roller disposed adjacent the main cylinder for transferring fibers thereto and (c) a fiber transfer roller interposed between the sealing roller and the fiber return feed roller for transferring fibers from the sealing roller to the fiber return feed roller, (d) said fiber return means being operative to form the discharged fibers into a thin uniform film of aligned fibers for uniform redistribution upon the main cylinder.

2. The device of claim 1, further including a rubber covered sealing roller.

3. The device of claim 1, wherein the fiber transfer roller and fiber return feed roller have wire-covered peripheries.

4. The device of claim 1, characterized by fiber control surfaces disposed proximate the peripheries of said sealing, fiber transfer and fiber return feed rollers.

5. The device of claim 1, further including (a) a rubber covered sealing roller, (b) a wire-covered fiber transfer roller, (c) a wire-covered fiber return feed roller and (d) curved control surfaces disposed adjacent each of said rollers to aid in maintaining consistent and uniform fiber flow from the suction chamber to the main cylinder.

6. The device of claim 1, characterized by a stationary filter disposed within the suction chamber to separate the fibers from suction air currents internally of said suction chamber.

7. The device of claim 1, wherein the suction chamber includes (a) a nozzle for sucking fibers from the doffer pneumatically, (b) a body member having a hollow interior connected to a source of suction and (c) a stationary filter to separate fibers in the suction chamber from suction air currents.

8. The device of claim 7, wherein the suction chamber is hollow and the filter is perforated and is disposed intermediate the hollow of the suction chamber and the hollow interior of the body member.

* * * * *